US005695377A

United States Patent [19]

Triebes et al.

[11] Patent Number: 5,695,377

[45] Date of Patent: Dec. 9, 1997

[54] NONWOVEN FABRICS HAVING IMPROVED FIBER TWISTING AND CRIMPING

[75] Inventors: Thomas Gregory Triebes, Atlanta; Jark Chong Lau, Roswell, both of Ga.

[73] Assignee: Kimberly-Clark Worldwide, Inc., Neenah, Wis.

[21] Appl. No.: 739,386

[22] Filed: Oct. 29, 1996

[51] Int. Cl.[6] ..... D01D 4/00; D01D 5/098; D01D 10/00; D01D 13/02; D02G 1/16

[52] U.S. Cl. ..... 442/359; 156/62.4; 264/12; 264/518; 264/210.8; 425/7; 425/66; 425/72.2; 425/83.1; 425/464; 442/400; 442/401

[58] Field of Search ..... 156/62.4; 264/12, 264/518, 210.8; 425/7, 66, 72.2, 83.1, 464; 442/359, 401, 400

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney . | |
| 3,502,763 | 3/1970 | Hartmann | 264/210 |
| 3,542,615 | 11/1970 | Dobo et al. | 156/181 |
| 3,692,618 | 9/1972 | Dorschner et al. | 226/97 |
| 3,754,694 | 8/1973 | Rebe . | |
| 3,802,817 | 4/1974 | Matsuki et al. | 425/66 |
| 3,849,241 | 11/1974 | Butin et al. . | |
| 3,940,145 | 2/1976 | Gentiluomo | 273/218 |
| 4,041,203 | 8/1977 | Brock et al. | 428/157 |

(List continued on next page.)

OTHER PUBLICATIONS

Walsh and Lindemann in "Optimization and Application of Riblets for Turbulent Drag Reduction", American Institute of Aeronautics and Astronautics (AIAA) Paper 84–0347, Jan. 1984.

Lazos and Wilkinson in "Turbulent Viscous Drag Reduction with Thin–Elements Riblets," AIAA Journal vol. 26, No. 4, p. 486 (1988).

"Riblets" in the book Viscous Drag Reduction in Boundary layers, edited by Dennis M. Bushnell and Jerry N. Hefner, published by AIAA (1990), ISBN 0–930403–66–5 vol. 123.

*Primary Examiner*—James C. Cannon

*Attorney, Agent, or Firm*—James B. Robinson

[57] ABSTRACT

There is provided a fabric produced by a spunbond or a meltblown apparatus, wherein the apparatus has a pneumatic chamber having at least one wall containing a plurality of spaced protrusions. Preferably, both opposing walls contain protrusions aligned in staggered angled rows and the rows on one wall are angled opposite the rows on the opposing wall, thereby causing controlled lateral flow near the chamber walls. This lateral flow exhibits drag on the fibers, imparting rotational energy to the fibers. The fibers are imparted with rotational energy derived from the lateral component of the two turbulent airflow fields that oppose one another, and have a tendency to twist and crimp. Fabrics so produced have improved loft, drape, and feel and may be useable as a loop material for hook-and-loop type fasteners.

29 Claims, 4 Drawing Sheets

U.S. PATENT DOCUMENTS

| | | | |
|---|---|---|---|
| 4,100,324 | 7/1978 | Anderson et al. | 428/288 |
| 4,102,662 | 7/1978 | Levecque et al. | 65/5 |
| 4,135,903 | 1/1979 | Ohsato et al. | 65/5 |
| 4,137,059 | 1/1979 | Levecque et al. | 65/5 |
| 4,140,509 | 2/1979 | Levecque et al. | 65/5 |
| 4,185,981 | 1/1980 | Ohsato et al. | 65/5 |
| 4,295,809 | 10/1981 | Mikami et al. | 425/72 S |
| 4,340,563 | 7/1982 | Appel et al. | 264/518 |
| 4,717,286 | 1/1988 | Loer | 405/74 |
| 4,744,564 | 5/1988 | Yamada | 273/232 |
| 4,818,464 | 4/1989 | Lau | 264/510 |
| 4,836,552 | 6/1989 | Puckett et al. | 273/218 |
| 4,839,116 | 6/1989 | Puckett et al. | 264/45.3 |
| 4,915,389 | 4/1990 | Ihara | 273/232 |
| 4,960,281 | 10/1990 | Aoyama | 273/232 |
| 5,005,838 | 4/1991 | Oka | 273/232 |
| 5,009,428 | 4/1991 | Yamagishi et al. | 273/232 |
| 5,024,444 | 6/1991 | Yamagishi et al. | 273/232 |
| 5,028,375 | 7/1991 | Reifenhauser | 264/518 |
| 5,078,637 | 1/1992 | McFarland | 446/46 |
| 5,087,048 | 2/1992 | Sun et al. | 273/232 |
| 5,104,126 | 4/1992 | Gentiluomo | 273/228 |
| 5,108,820 | 4/1992 | Kaneko et al. | 428/198 |
| 5,108,827 | 4/1992 | Gessner | 428/219 |
| 5,114,099 | 5/1992 | Gao | 244/130 |
| 5,143,377 | 9/1992 | Oka et al. | 273/232 |
| 5,145,727 | 9/1992 | Potts et al. | 428/198 |
| 5,169,706 | 12/1992 | Collier IV et al. | 428/152 |
| 5,171,623 | 12/1992 | Yee | 428/156 |
| 5,178,931 | 1/1993 | Perkins et al. | 428/198 |
| 5,188,885 | 2/1993 | Timmons et al. | 428/198 |
| 5,192,078 | 3/1993 | Woo | 273/232 |
| 5,192,079 | 3/1993 | Sun et al. | 273/232 |
| 5,200,573 | 4/1993 | Blood | 102/501 |
| 5,203,933 | 4/1993 | Nagahisa | 152/209 R |
| 5,289,997 | 3/1994 | Harris | 244/130 |
| 5,308,076 | 5/1994 | Sun | 273/232 |
| 5,336,552 | 8/1994 | Strack et al. | 428/224 |
| 5,338,039 | 8/1994 | Oka et al. | 273/232 |
| 5,356,150 | 10/1994 | Lavallee et al. | 273/232 |
| 5,377,989 | 1/1995 | Machin | 273/232 |
| 5,378,524 | 1/1995 | Blood | 428/141 |
| 5,382,400 | 1/1995 | Pike et al. | 264/168 |
| 5,441,276 | 8/1995 | Lim | 273/232 |
| 5,445,095 | 8/1995 | Reed et al . | 114/67 A |

NONWOVEN FABRICS HAVING IMPROVED FIBER TWISTING AND CRIMPING

FIELD OF THE INVENTION

The present invention relates to the field of nonwoven fabrics and methods for making fibers using spunbond or meltblown processes.

BACKGROUND OF THE INVENTION

This invention relates to the field of nonwoven fabrics. The manufacture of nonwoven fabrics like meltblown and spunbond fabrics involves the attenuation of polymer streams, generally in a fluid such as air. In spunbond fiber production, for example, fibers are attenuated within a chamber called a drawing unit and deposited onto a moving conveyor belt called a forming wire. In meltblown fiber production the drawing unit usually consists of only a nozzle through which polymer flows and is then attenuated pneumatically before deposition onto the forming wire.

Self-crimping fibers are normally created using conjugate fiber construction, i.e., two or more different polymers, which are melted and spun together in a side-by-side or other arrangement. Crimping usually requires a post-fiber formation treatment step, or a heated draw unit, adding to the cost and time to produce the nonwoven fabric. It would be desirable to have a one step process for producing fibers exhibiting self-crimping characteristics in single polymer, or "homofiber", composition.

Fabrics composed of twisted fibers typically exhibit greater strength characteristics and higher loft than fabrics composed of untwisted fibers. Twisting is not commonly achieved. It would be desirable to have a process for producing twisted fibers that could be achieved during the fiber attenuation stage.

U.S. Pat. No. 3,754,694, issued to Reba, discloses a device for accelerating passage of filaments therethrough using at least two baffle means disposed in the fluid inlet portion of the device.

U.S. Pat. Nos. 4,102,662; 4,137,059 and 4,140,509, issued to Levecque et al., disclose the use of a pair of high velocity whirling currents or tornadoes of air, where each of the gases in the two tornadoes turns in opposite directions, imparting a twisting effect on the fibers produced.

U.S. Pat. Nos. 4,135,903, and 4,185,981, issued to Ohsato et al., disclose a method of producing fibers from a thermoplastic material extruded into fibers incorporating two high speed gas streams directed from opposite directions toward the fiber stream, each gas stream having a component in a direction tangential to the fiber flow. The effect is to impart a rotational force on the fiber.

U.S. Pat. No. 4,295,809, issued to Mikami et al., discloses a meltblowing die having a movable spacer in each of the gas slots to provide effective uniformity in the gas streams across the width of the die.

The effect on turbulence of grooves or ribs in certain applications has been investigated by Walsh and Lindemann in "Optimization and Application of Riblets for Turbulent Drag Reduction", American Institute of Aeronautics and Astronautics (AIAA) Paper 84–0347, January 1984, by Lazos and Wilkinson in *"Turbulent Viscous Drag Reduction with Thin-Element Riblets", AIAA Journal vol.* 26, no. 4, p. 486 (1988), in U.S. Pat. No. 5,445,095 issued to Helfrich which is directed to liquid turbulence and additionally uses a drag reducing polymer, and by Walsh in an article entitled "Riblets" in the book Viscous Drag Reduction in Boundary Layers, edited by Dennis M. Bushnell and Jerry N. Hefner, published by AIAA (1990), ISBN 0-930403-66-5, and by others. These references are directed to the reduction of drag in a fluid stream in the boundary layer by the use of riblets, ribs or grooves.

None of these references teaches or suggests the improvement in the loft of a nonwoven web which is the subject of this invention.

Accordingly, it is an object of the present invention to provide a nonwoven fabric which is produced in a novel way which increases web strength, softness and feel.

It is a further object of the present invention to provide an apparatus having a plurality of protrusions associated with the interior walls of the fiber draw unit, which protrusions cause turbulence of air passing thereover, imparting rotational stress on fibers passing through the unit.

It is another object of the present invention to provide a process for producing a twisted homofiber which crimps during the attenuation step.

SUMMARY OF THE INVENTION

The objects of the invention are provided by a nonwoven fabric or web which has been produced in a pneumatic chamber which has a plurality of protrusions over an effective amount of the interior walls of the fluid contacting surface.

Generally described, the present invention provides a first embodiment comprising a spunbond process in which the interior walls of the fiber draw unit, particularly at the nozzle end proximity, have a series of protrusions preferably spaced in staggered angled rows. The protrusions are preferably rounded hemispherical bumps protruding from the wall surface. The protrusions are either machined as part of the wall or attached thereto, such as a sheet of thin material containing the protrusions being adhered to the walls. Preferably, the rows of protrusions overlap and are at an angle from the vertical of from about 0° to about 45°, more preferably from about 10° to 30°. Preferably the rows on one wall are oriented in a direction opposite the rows of the opposing wall. As fluid, typically air, is passed through the fiber draw unit the protrusions cause controlled lateral turbulence in the airflow, in the areas near (local to) the protrusions. The lateral component of the turbulent flow field exhibits drag on the fibers, tangential to the radius, imparting rotational energy to the fibers. The fibers passing therethrough are imparted with rotational energy derived from the lateral component of the two turbulent airflow fields that oppose one another, and have a tendency to twist and crimp.

Fibers produced thereby exhibit a degree of self-crimping and twisting, which results in a stronger, softer fabric.

The protrusions of the present invention are also usable in the air jets of a meltblown process for creating similar turbulence.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DEFINITIONS

Figure 1:
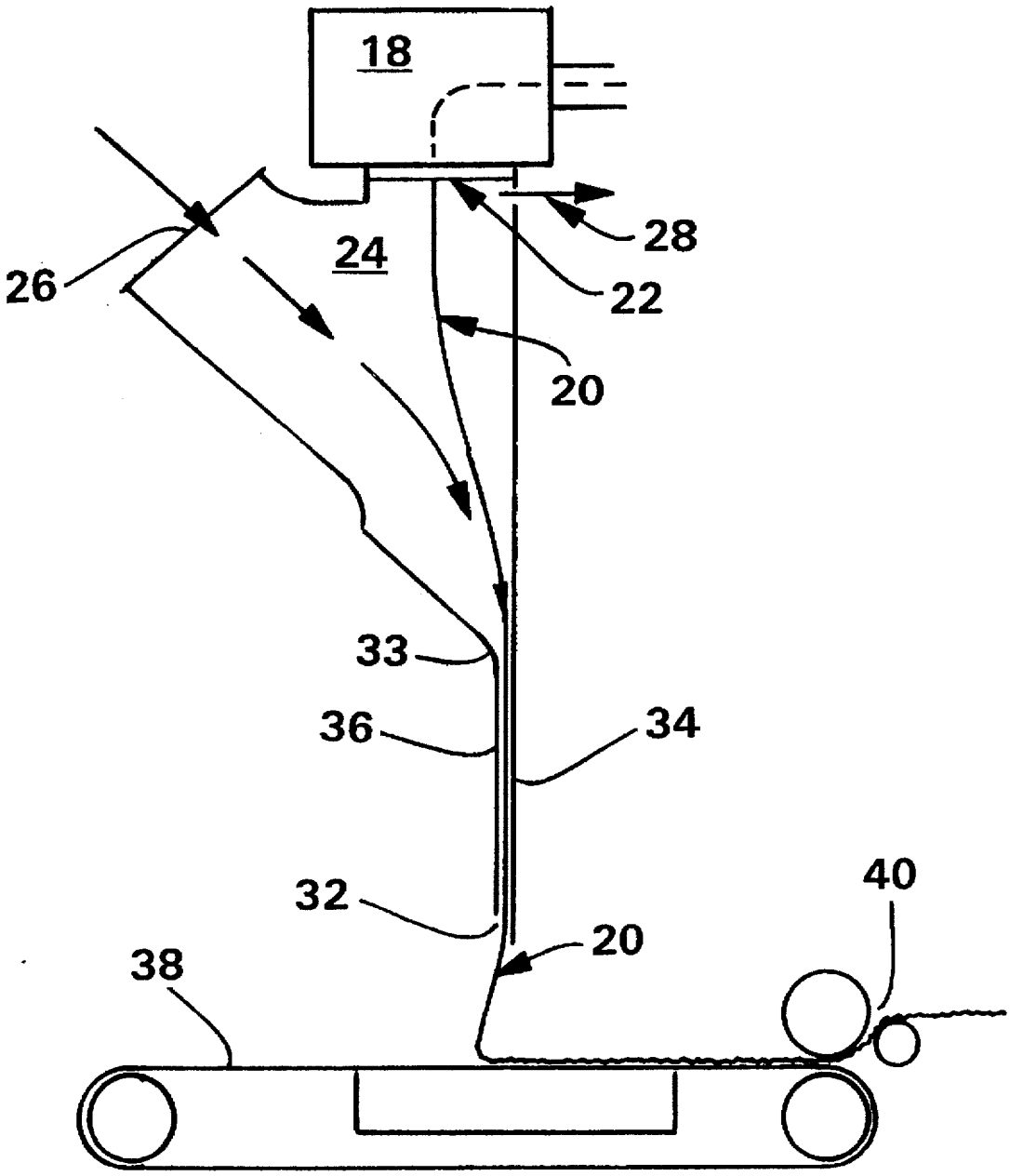
FIG. 1 is a schematic view of a typical drawing unit for producing spunbond webs.

As Used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as they are quenched, drawn, usually pneumatically, and deposited on a moving foraminous mat, belt or "forming wire" to form the nonwoven fabric. Examples of this process may be found, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al. and U.S. Pat. No. 5,028,375 to Reifenhauser. Spunbond fibers are quenched and, therefore, generally not tacky when they are deposited onto a collecting surface. Spunbond fibers are generally continuous and have average diameters (from a sample of at least 10) larger than 7 microns, more particularly, between about 10 and 40 microns.

As used herein "multilayer laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such laminated fabrics usually have a basis weight of from about 0.1 to 12 osy (6 to 400 gsm), or more particularly from about 0.75 to about 3 osy (25 to 102 gsm). Multilayer laminates may also have various numbers of meltblown layers or multiple spunbond layers in many different configurations and may include other materials like films (F) or coform materials, e.g., SMMS, SM, SFS, etc.

As used herein, the term "coform" means a process in which at least one meltblown diehead is arranged near a chute through which other materials are added to the web while it is forming. Such other materials may be pulp, superabsorbent particles, cellulose or staple fibers, for example. Coform processes are shown in commonly assigned U.S. Pat. No. 4,818,464 to Lau and U.S. Pat. No. 4,100,324 to Anderson et al. Webs produced by the coform process are generally referred to as coform materials. An example of a product often made by the coform process is a baby wipe.

As used herein the term "polymer" generally includes but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook Polymer Blends and Composites by John A. Manson and Leslie H. Sperling, copyright 1976 by Plenum Press, a division of Plenum Publishing Corporation of New York, IBSN 0-306-30831-2, at pages 273 through 277.

As used herein, the term "machine direction" or MD means the length of a fabric in the direction in which it is produced. The term "cross machine direction" or CD means the width of fabric, i.e., a direction generally perpendicular to the MD.

As used herein, the term "point unbonded" refers to the technique, similar to point bonding, in which a set of calendar niprolls are used with one roll having a flat surface (the anvil roll) and the other roll being substantially flat and having a series of spaced depressions on its surface so that when material is passed through the nip assembly the material is bonded except for the areas contacting the depressions. This technique is used to make loops of fabric on a flat background (the bonded area) of the fabric, such as for use as "hook and loop" material.

As used herein, the term "garment" means any type of non-medically oriented apparel which may be worn. This includes industrial work wear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls, aprons and jackets, patient bedding, stretcher and bassinet sheets, and the like.

As used herein, the term "personal care product" means diapers, training pants, absorbent underpants, adult incontinence products, and feminine hygiene products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

DETAILED DESCRIPTION

The processes for which this invention may be useful are the meltblowing or spunbonding processes which are nonwoven fabric production methods which are well known in the art. These processes generally use an extruder to supply melted thermoplastic polymer to a die or spinneret where the polymer is fiberized to yield fibers which may be staple length or longer. The fibers are then drawn, usually pneumatically, and deposited on a moving foraminous mat or belt to form the nonwoven fabric. The fibers produced in the spunbond and meltblown processes are microfibers as defined above.

Nonwoven fabrics are used in the production of garments, infection control products, personal care products and protective covers.

Spunbond nonwoven fabric is produced by a method known in the art and described in a number of the references cited above. Briefly, the spunbond process generally uses a hopper which supplies polymer to a heated extruder. The extruder supplies melted polymer to a spinneret where the polymer is fiberized as it passes through fine openings usually arranged in one or more rows in the spinneret, forming a curtain of filaments. The filaments are usually quenched with air, drawn, usually pneumatically, and deposited on a moving foraminous mat, belt or "forming wire" to form the nonwoven fabric.

The fibers produced in the spunbond process are usually in the range of from about 10 to about 40 microns in diameter, depending on process conditions and the desired end use for the fabrics to be produced from such fibers. For example, increasing the polymer molecular weight or decreasing the processing temperature result in larger diameter fibers. Changes in the quench fluid temperature and pneumatic draw pressure can also affect fiber diameter.

Polymers useful in the spunbond process generally have a process melt temperature of between about 300° F. to about 610° F. (149° C. to 320° C.), more particularly between about 350° F. and 510° F. (175° C. and 265° C.) and a melt flow rate, as defined above, in the range of about 10 to about 150, more particularly between about 10 and 50. Examples of suitable polymers include polypropylenes, polyethylenes and polyamides.

Conjugate fibers may also be used in the practice of this invention. Conjugate fibers are commonly polypropylene and polyethylene arranged in a sheath/core, "islands in the sea" or side by side configuration. Biconstituent fibers may also be used in the practice of this invention. Blends of a polypropylene copolymer and polybutylene copolymer in a 90/10 mixture have been found effective. Any other blend would be effective as well provided it may be spun.

This invention pertains particularly to the process used to cool and attenuate the fibers after they are produced by the spinneret. The spunbonding patents cited above, though describing somewhat different processes, have in common that they provide a chamber for pneumatically attenuating the fibers prior to formation of a web. This chamber may be seen in FIG. 1 as item 32 and is sometimes referred to in the cited spunbond patents as a "draw-off tube" (Dorschner), a "sucker unit" (Matsuki), "filament passageway" (Kinney), "yarn passageway" (Kinney), "guide passageway" (Hartmann), "venturi nozzle" (Reifenhauser) and "aspirator" (Dobo). The combination of the quench chamber and drawing nozzle is referred to as the drawing unit.

Figure 4:
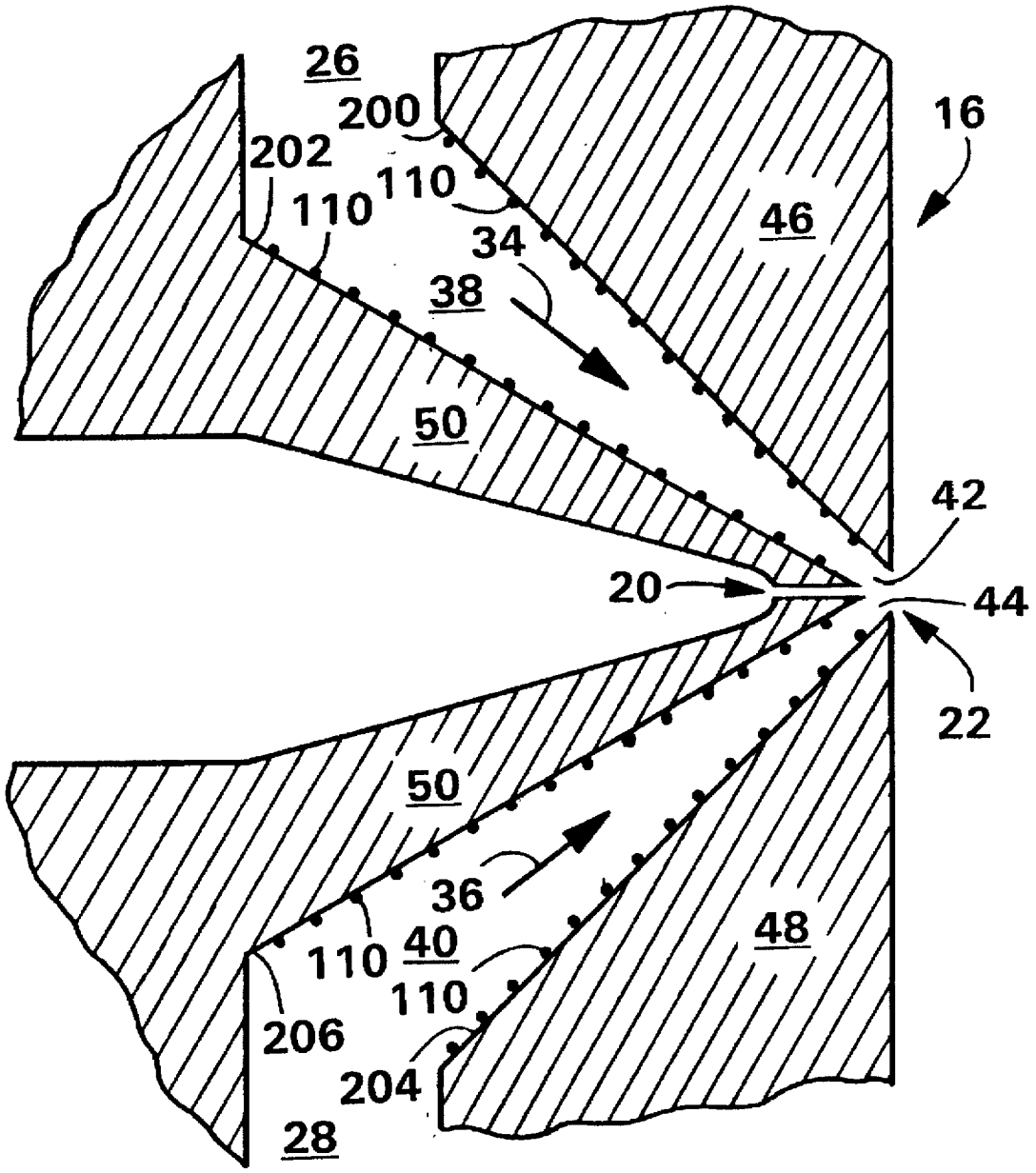
FIG. 4 is a cross-sectional view of the die of FIG. 3 taken along line 3—3.

When used in meltblowing the drawing unit usually includes only a drawing nozzle having chambers and gaps as shown in FIG. 4 as items 38, 40 and 42, 44 and which may have a series of spaced apart protrusions projecting from the interior walls in accordance with this invention, as will be described in greater detail hereinbelow. The instant invention is therefore, suitable for use in any fiber producing process which relies on pneumatically drawing fibers. Accordingly, this invention is specifically contemplated to encompass not only spunbond processes but also meltblown processes and others. In order to properly encompass these processes, the term "pneumatic chamber" as used herein means includes at least the spunbonding drawing unit and the meltblowing chambers and gaps.

In FIG. 1, an example of a spunbonding process, the spinneret 22 may be of conventional design and arranged to provide extrusion of filaments 20 from spin box 18 in one or more rows of evenly spaced orifices across the full width of the machine into the quench chamber 24. The size of the quench chamber will normally be only large enough to avoid contact between the filaments and the side and to obtain sufficient filament cooling. The filaments 20 simultaneously begin to cool from contact with the quench fluid which is supplied through inlet 26 in a direction preferably at an angle having the major velocity component in the direction toward the nozzle entrance. The quench fluid may be any of a wide variety of gases as will be apparent to those skilled in the art, but air is preferred for economy. A portion of the quenching fluid is directed through the filaments 20 and withdrawn through exhaust port 28.

Immediately after extrusion through the orifices, acceleration of the strand movement occurs due to tension in each filament generated by the aerodynamic drawing means. The filaments 20 accelerate between the walls 34, 36, particularly starting at the upper portion 33 and exit through nozzle 32 where they may be gathered onto foraminous mat or belt 38 to form a nonwoven web 40.

In the practice of this invention in spunbond applications, the series of protrusions should extend at least a major portion of the distance from the upper end 33 to the nozzle 32.

The manufacture of meltblown webs is discussed generally above and in the references and may also be accomplished according to the following general procedure.

Figure 2:
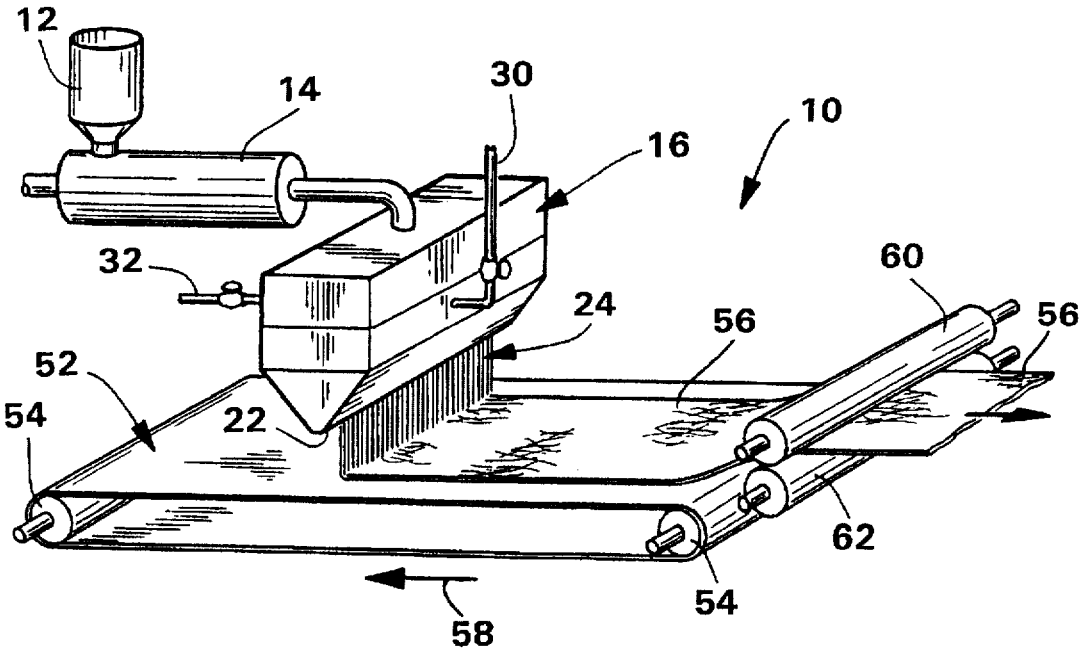
FIG. 2 is a schematic view of a typical apparatus for forming meltblown webs.

Turning now to FIG. 2, it can be seen that an apparatus for forming meltblown web is represented by the reference number 10. In forming the nonwoven web of the present invention, pellets, beads or chips (not shown) of a suitable material are introduced into a hopper 12 of an extruder 14. The extruder 14 has an extrusion screw (not shown) which is driven by a conventional drive motor (not shown). As the material advances through the extruder 14, due to rotation of the extrusion screw by the drive motor, it is progressively heated to a molten state. Heating of the material may be accomplished in a plurality of discrete steps with its temperature being gradually elevated as it advances through discrete heating zones of the extruder 14 toward a meltblowing die 16. The die 16 may be yet another heating zone where the temperature of the thermoplastic resin is maintained at an elevated level for extrusion. The temperature which will be required to heat the material to a molten state will vary somewhat depending upon exactly which material is utilized and can be readily determined by those in the art.

Figure 3:
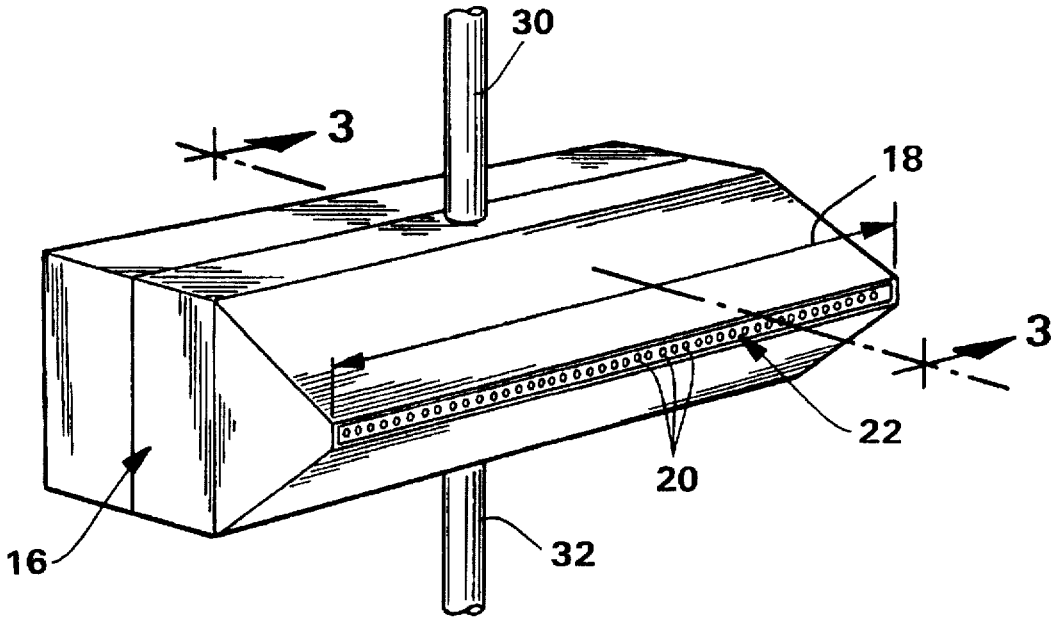
FIG. 3 is a detail schematic view of the meltblowing die shown as item 16 in FIG. 2.

FIG. 3 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.30 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from abut 20 inches to about 60 inches or more. FIG. 2 illustrates that the molten material emerges from the orifices 20 of the die 16 as molten strands or threads 24.

FIG. 4, which is a cross-sectional view of the die of FIG. 3 taken along line 3—3, illustrates that the die 16 preferably includes attenuating gas sources 30 and 32 (see FIGS. 2 and 3). The heated, pressurized attenuating gas enters the die 16 at the inlets 26, 28 and follows a path generally designated by arrows 34, 36 through the two chambers 38, 40 and on through the two narrow passageways or gaps 42, 44 so as to contact the extruded threads 24 as they exit the orifices 20 of the die 16. The chambers 38, 40 are designed so that the heated attenuating gas passes through the chambers 38, 40 and exits the gaps 42, 44 to form a stream (not shown) of attenuating gas which exits the die 16 on both sides of the threads 24. It is the interior walls of the chambers 38, 40 and gaps 42, 22 which have the series of protrusions in the practice of this invention. The temperature and pressure of the heated stream of attenuating gas can vary widely. For example, the heated attenuating gas can be applied at a temperature of from about 220° to about 315° C. (425°–600° F.), more particularly, from about 230° to about 280° C. The heated attenuating gas may generally be applied at a pressure of from about 0.5 pounds per square inch gage (psig) to about 20 psig. More particularly, from about 1 to about 10 psig.

The position of the air plates 46, 48 which, in conjunction with a die portion 50 define the chambers 38, 40 and the gaps 42, 44, may be adjusted relative to the die portion 50 to increase or decrease the width of the attenuating gas passageways 42, 44 so that the volume of attenuating gas passing through the air passageways 42, 44 during a given time period can be varied without varying the velocity of the attenuating gas. Furthermore, the air plates 46, 48 may be adjusted to effect a "recessed" die tip 22 configuration as illustrated in FIG. 4, or a positive die tip 22 stick out configuration wherein the tip of the die portion 50 protrudes beyond the plane formed by the plates 48. Lower attenuating gas velocities and wider air passageway gaps are generally preferred if substantially continuous meltblown fibers or microfibers 24 are to be produced.

The two streams of attenuating gas converge to form a stream of gas which entrains and attenuates the molten threads 24, as they exit the orifices 20, into fibers or, depending on the degree of attenuation, microfibers of a small diameter which is usually less than the diameter of the orifices 20. The gas-borne fibers or microfibers 24 are blown by the action of the attenuating gas onto a collecting arrangement which, in the embodiment illustrated in FIG. 2, is a foraminous endless belt 52 conventionally driven by rollers 54. Other foraminous arrangements such as a rotating drum could be used. One or more vacuum boxes (not shown) may be located below the surface of the foraminous belt 52 and between the rollers 54. The fibers or microfibers 24 are collected as a coherent matrix of fibers on the surface of the endless belt 52 which is rotating as indicated by the arrow 58 in FIG. 2. The vacuum boxes assist in retention of the matrix on the surface of the belt 52. Typically, the tip 22 of the die 16 is from about 6 inches to about 14 inches from the surface of the foraminous belt 52 upon which the fibers 24 are collected. The thus collected, entangled fibers or microfibers 24 are coherent and may be removed from the belt 52 as a self-supporting nonwoven web 56.

Figure 5:
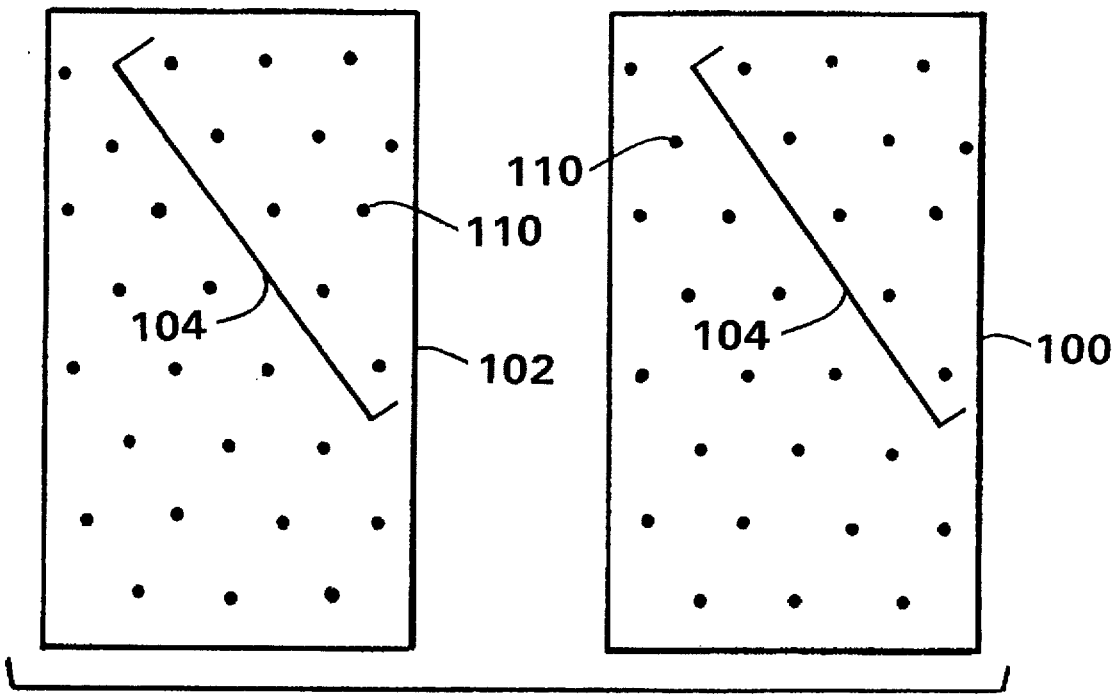
FIG. 5 is a detail schematic view of a section of the interior walls of the pneumatic chamber.

FIG. 5 shows front schematic views of a portion of a pair of opposing interior walls 100 and 102. These walls are similar in general relative positioning inside the pneumatic chamber in the spunbond apparatus and chambers and gaps in the meltblown apparatus, i.e., they oppose each other, have a fluid passageway defined between the walls and may be either generally parallel, slightly converging, or slightly diverging. For the purposes of the present discussion, both walls 100 and 102 will incorporate the protrusions. It is to be understood that the present invention contemplates either one or both walls 100, 102 as incorporating the protrusions.

The protrusions will be discussed initially with respect to the walls of the pneumatic chamber as part of the spunbond apparatus. In a preferred embodiment the walls 100 and 102 have a series of angled rows 104, each row comprising a series of protrusions 110. The protrusion 110 is raised with respect to the wall surface and may be of any of a number of shapes, or of a variety of shapes and sizes, including, but not limited to, double sloped (two gradients on the same protrusion), rounded "U", pointed, squared "U", hemispherical, elongated, rounded "V" shaped, ridged (i.e., having grooves, ridges, depressions or valleys within the raised portion), crescent or "C" shaped, "T" shaped, or the like. All suitable geometric shapes or angles are contemplated as being within the scope of the present invention. It is preferable that the protrusions be shaped so that the fibers passing thereover do not catch or stick on the protrusions, which would cause clogging. Therefore, typically, it is preferable that the rounded protrusions be sufficiently raised as to create turbulence yet not so high or prominent as to catch the fibers as they pass thereover. Additional factors regarding the protrusions 110 include composition (e.g., hollow, solid, deformable, or rigid), size, length, height, spacing, distribution, geometry, and surface topography (e.g., protrusions 110 can have smooth, ridged, channeled, rough, perforated (i.e., spongelike) dimpled or otherwise textured surfaces). Moreover, the protrusions 110 can be of different shapes, such as random or rows of shaped protrusions, or even a gradient of sized protrusions.

The protrusions 110 can be associated with the walls 100 and 102 in a variety of different ways. The protrusions 110 can be cast or otherwise machined as part of the wall structure (if the walls 100 and 102 are formed in this manner). Alternatively, the protrusions 110 can be affixed to or integrated with a sheet of material, such as metal or plastic, for example, where the protrusions are indented through the sheet from the back side. The sheet can then be fastened to the wall 100 or 102, such as by an adhesive, welding, screws, bolts, mated tongue and groove construction (where the sheet would have at least one tongue which would slide within a mating groove in the wall), male and female mating snaps, electrostatic attraction, hook and loop tape, and the like. Several of these fastening means permit the removal of the sheets should they need to be replaced. It may be that a removable sheet of thin metal or plastic having the protrusions 110 therein is more cost effective than forming the protrusions 110 directly on the wall surface. Spacing of the walls apart from each other should be taken into consideration in designing the pneumatic chamber, since the sheet thickness may reduce the width of the fluid passageway.

The protrusions 110 can be arranged in any of a number of different spatial arrangements, or randomly. In a preferred embodiment, the protrusions 110 are arranged in a number of offset angled rows 104, as shown in FIG. 5. The rows 104 overlap and have an angle from the vertical of at least about 0° to 45°, more preferably from about 15° to about 35°.

FIG. 5 shows the walls 100 and 102 as both facing the observer. In a preferred embodiment the apparatus walls 100 and 102 face each other such that the rows 104 on wall 100 are preferably not parallel to the rows 104 on the opposing wall 102, i.e., the rows "cross" if viewed from the front or back, the significance of which is discussed in detail hereinbelow. Alternatively, it is possible for the rows 104 to be parallel.

The protrusions 110 are preferably disposed along the wall portion of the pneumatic chamber 24 between the upper portion 33 and the nozzle 32. While the protrusions can be placed further upward into the chamber 24, the effectiveness diminishes because of the enlarged chamber volume.

In a spunbond process, fluid, such as air, enters the inlet 26 and flows through to the narrower upper portion 33 and exits the nozzle 32. Filaments 20 are drawn through the chamber between the walls 34 and 36 and exit the nozzle 32. In the prior art, the walls 34 and 36 are substantially smooth and create minimal turbulence, which heretofore was considered desirable. The protrusions 110 of the present invention induce turbulence within the passageway among the air and fibers passing therethrough. It is believed that the turbulence occurs at two levels: microturbulence and macroturbulence. Microturbulence occurs as air passes over (and around) one and between two of the protrusions 110, creating a mini-disruption in airflow and a mini-vortex. Macroturbulence occurs as air is passed over the entire wall surface, with airflow disruption occurring between and among the rows 104.

Additionally, turbulence and shear is created by the interaction of air between the two walls, i.e., the tendency of the air passing over wall 100 to be shunted in an angle, while air passing over wall 102 is shunted at a complementary angle, thus the air "shears" the fibers in a circumferential direction, imparting rotation around their central axis. An analogy is that the walls 100 and 102 cause rifling of the air, like a bullet passing through a rifled gun barrel. The shearing action imparts a twist on the fibers passing through the passageway.

Fibers produced by one embodied process of the present invention exhibited crimping in the range of about 7–30 helical crimps per inch. It is believed that about 7–200 helical crimps per inch are possible by altering the protrusion 110 configuration and flow rate.

Twisted fibers produced by the above apparatus typically have certain improved characteristics as compared to untwisted fibers, such as a softer feel, improved drapability, improved strength (due to formation of twisted coils), and improved crimp. The fibers self-crimp, using the energy of the air shearing them in a circumferential (axial) direction. Normally, crimping requires conjugate fiber composition, whereas an advantage of the present invention is that a homofiber exhibits self-crimping.

The present invention can be incorporated into a meltblown apparatus as follows. FIG. 4 shows walls 200 and 202 as forming the passageway 38 and walls 204 and 206 as forming the passageway 40. The pairs of walls are generally the same as the walls 100 and 102 in surface and protrusion construction, however, each pair of walls preferably converges toward the tip 22. The protrusions 110 on the walls provide lateral momentum to the air flow field that is equal and opposite with respect to the opposing side. This lateral momentum is exerted on the fibers, and it ultimately changes the quench efficiency and hence the physical characteristics of the meltblown fibers.

Fabric produced according to the embodiments of the present invention can be further processed by point bonding or point unbonding procedures which post-treat the fabric to form either a flat or raised loop surface, for, for example, hook-and-loop type fasteners, depending on the characteristics desired.

A further advantage of the present invention is that the protrusion pattern could be used to impart rotational energy to the fibers, which may aid in splitting conjugate fibers. This reduces the overall fiber size which increases coverage, making material appear to have a higher basis weight than it actually does. Materials are made to appear heavier and are stronger when smaller fibers are used to make the material.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A nonwoven web produced using a pneumatic chamber having first and second interior walls, at least one of said walls containing a plurality of spaced apart protrusions, which web has superior crimping compared to a similar web produced using a pneumatic chamber not having a plurality of spaced apart protrusions.

2. The web of claim 1, wherein said protrusions are rounded bumps.

3. The web of claim 1, wherein said protrusions are elongated bumps.

4. The web of claim 1, wherein said protrusions are bumps having at least two different shapes.

5. The web of claim 1, wherein said protrusions are shaped such that fluid turbulence is created when fluid is passed over the protrusions, resulting in shearing force being applied to fibers passing therethrough, and wherein said protrusions are sufficiently streamlined as to prevent said fibers from catching on said protrusions.

6. The web of claim 1, wherein said protrusions are spaced in rows angled with respect to the direction of fluid flow capable of flowing through said chamber.

7. The web of claim 4, wherein said rows are angled from the vertical from about 0° to about 45°.

8. The web of claim 4, wherein said rows are angled from the vertical from about 10° to about 30°.

9. The web of claim 4, wherein said angled rows are on both said first and said second walls such that said rows on said first wall are offset from said rows on said second wall.

10. The web of claim 1, wherein said chamber is part of a spunbond apparatus.

11. The web of claim 1, wherein said chamber is part of a meltblown apparatus.

12. The web of claim 1, wherein said protrusions are formed as part of said walls.

13. The web of claim 1, wherein said protrusions are applied to at least one of said walls.

14. The web of claim 13, wherein said protrusions are applied to said at least one wall as a sheet having said protrusions thereon.

15. The web of claim 14, wherein said sheets are affixed to said wall by a fastening means.

16. The web of claim 15, wherein said fastening means is selected from the group consisting of an adhesive, welding, screws, bolts, mated tongue and groove construction, male and female mating snaps, and hook and loop tape.

17. A method of producing a nonwoven web, comprising the step of drawing thermoplastic fibers with fluid through a pneumatic chamber, wherein said pneumatic chamber has at least one wall containing a plurality of spaced apart protrusions.

18. The method of claim 17, wherein said drawing step causes said fibers to crimp.

19. The method of claim 17, wherein said protrusions are rounded bumps.

20. The method of claim 17, wherein said protrusions are elongated bumps.

21. The method of claim 17, wherein said protrusions are bumps having at least two different shapes.

22. The method of claim 17, wherein said protrusions are spaced in rows angled with respect to the direction of fluid flow capable of flowing through said chamber.

23. The method of claim 22, wherein said rows are angled from the vertical from about 0° to about 45°.

24. The method of claim 22, wherein said rows are angled from the vertical from about 10° to about 30°.

25. The method of claim 22, wherein said angled rows are on both said first and said second walls such that said rows on said first wall are offset from said rows on said second wall.

26. The method of claim 17, wherein said protrusions are applied to each wall as a sheet having said protrusions thereon.

27. The method of claim 26, wherein said sheets are affixed to said wall by a fastening means.

28. An apparatus for producing spunbond fibers, comprising a pneumatic chamber having at least one wall containing a plurality of spaced apart protrusions.

29. An apparatus for producing meltblown fibers, comprising a pneumatic chamber having at least one wall containing a plurality of spaced apart protrusions.

* * * * *

UNITED STATES PATENT AND TRADEMARK OFFICE

CERTIFICATION OF CORRECTION

PATENT NO. : 5,695,377

DATED : December 9, 1997

INVENTOR(S): Triebes et al.

It is certified that an error appears in the above-identified patent and that said Letters Patent is hereby corrected as shown below:

Column 10, line 57, "surface, for, for example," should read --surface, for example,--.

Signed and Sealed this

Eleventh Day of August 1998

Bruce Lehman

*Attest:*

BRUCE LEHMAN

*Attesting Officer*

*Commissioner of Patents and Trademarks*